US005405130A

United States Patent [19]

Maass

[11] Patent Number: 5,405,130

[45] Date of Patent: Apr. 11, 1995

[54] SAFETY DEVICE AND METHOD IN A SHEET FEEDER OF A SHEET-FED PROCESSING MACHINE

[75] Inventor: Burkhard Maass, Heidelberg, Germany

[73] Assignee: Heidelberger Druckmaschinen AG, Heidelberg, Germany

[21] Appl. No.: 114,219

[22] Filed: Aug. 30, 1993

[30] Foreign Application Priority Data

Aug. 28, 1992 [DE] Germany ..... 42 28 621.2

[51] Int. Cl.[6] ..... B65H 1/08; B65H 1/30

[52] U.S. Cl. ..... 271/147; 271/159

[58] Field of Search ..... 271/147, 152–159

[56] References Cited

U.S. PATENT DOCUMENTS

| | | | |
|---|---|---|---|
| 669,678 | 3/1901 | Bridgewater | 271/147 |
| 1,866,562 | 7/1932 | Graf | 271/157 |
| 3,035,835 | 5/1962 | Reif et al. | 271/159 |
| 3,446,501 | 5/1969 | Gates | 271/147 |

FOREIGN PATENT DOCUMENTS 1029835 10/1958 Germany .

867036 3/1961 United Kingdom .

OTHER PUBLICATIONS

Patent Abstract of Japan No. JP 62–285827 (Aoki) Dec. 11, 1987.

Patent Abstract of Japan No. JP 58–135040 (Tonomura) Aug. 11, 1983.

*Primary Examiner*—Robert P. Olszewski

*Assistant Examiner*—Boris Milef

*Attorney, Agent, or Firm*—Herbert L. Lerner; Laurence A. Greenberg

[57] ABSTRACT

Safety device in a sheet feeder of a sheet-fed processing machine includes a freely revolving pile-lifting chain for lifting and lowering a feed pile, a first drive for entraining pile-lifting chain with a driving connection so as to lift the feed pile, a second drive for entraining the pile-lifting chain with a driving connection so as to lower the feed pile, and a device for disconnecting at least one of the driving connections of the first and the second drives with the pile-lifting chain for lowering the feed pile when a limit value for a force exerted by the feed pile upon the pile-lifting chain is exceeded; and a safety method.

6 Claims, 4 Drawing Sheets

SAFETY DEVICE AND METHOD IN A SHEET FEEDER OF A SHEET-FED PROCESSING MACHINE

SPECIFICATION

Figure 1:
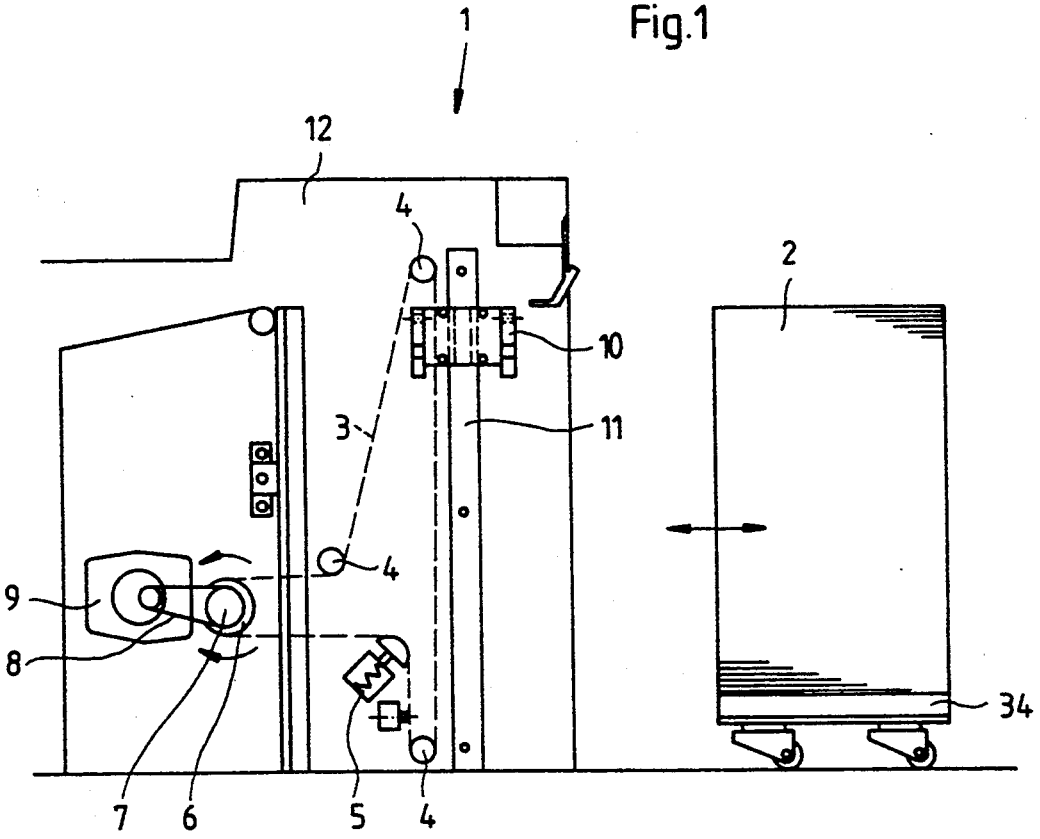

The invention relates to a safety device and a safety method in a sheet feeder of a sheet-fed processing machine.

It has been known heretofore to raise a feed pile in a sheet feeder of a sheet-fed processing machine, such as a sheet-fed printing press, by means of powered or driven lift chains. It has also become known heretofore that, in order to ensure a defined, tilting or canting-free , i.e., non-jamming, lowering of the feed pile and the lift chains, respectively, for providing increased safety in the take-up of a new pile, a revolving feed-pile chain which is driven in both directions may be used. With heretofore known constructions a rigid drive linkage is provided between the drive and the chain. When the feed pile is lowered, the pile or the chain is driven downwardly. If, due to an operator error, for example, the next feed pile is already in the take-up position, or if other objects or the foot of a by-stander, such as the operator, is below the feed pile then being fed, the pile is driven with full drive force and weight of the pile down onto this obstacle or foot. The heavy masses can further be pressed against the object by the motor, which continues to operate. The continuously applied drive forces and weight can cause significant damage to the machine and injuries to personnel. After a collision has occurred, simply turning off the motor does not eliminate further action by the torque of the motor, i.e., the motor flywheel effect, and the forces resulting therefrom.

German Utility Model (DE-GM) 69 28 452 discloses the use of a freewheel or overrunning clutch to provide a drive connection between a drive and a lift chain for lifting the lift chain. When the lift chain is lowered, the drive connection is interrupted. In particular, a reliable or safe downward motion is assured by a guaranteed overcoming of frictional forces and the forces which must be overcome by the take-up gear for taking up the feed pile. Independently thereof, the use of a friction disc clutch instead of a free-wheeling clutch has become known heretofore from German Utility Model (DE-GM) 69 28 452. The application of such a friction disc clutch, which is not disclosed in greater detail, instead of a free-wheeling or overrunning clutch would require proper dimensioning of the friction disc clutch for reliably or safely driving the heavily loaded feed pile. The forces which must be transmitted during lifting must also be transmitted when lowering the file. The aforementioned dangers associated with high transmissible torques during the lowering of the pile are not avoided by this heretofore-known drive connection.

It is accordingly an object of the invention, to provide a safety device in a sheet feeder of a sheet-fed processing machine, comprising a freely revolving pile-lifting chain for lifting and lowering a feed pile, first drive means for entraining the pile-lifting chain with a driving connection so as to lift the feed pile, second drive means for entraining the pile-lifting chain with a driving connection so as to lower the feed pile, and means for disconnecting at least one of the driving connections of the first and the second drive means with the pile-lifting chain for lowering the feed pile when a limit value for a force exerted by the feed pile upon the pile-lifting chain is exceeded.

In accordance with another aspect of the invention, there is provided a safety method in a sheet feeder of a sheet-fed processing machine, which comprises driving a freely revolving pile-lifting chain by means of a drive having a drive connection therewith so as to lift a feed pile, driving the pile-lifting chain so as to lower the feed pile until a limit value for a force acting upon the pile-lifting chain is reached, and disconnecting the drive connection between the freely revolving pile-lifting chain from the drive above this limit value.

By means of such a safety device and such a safety method, respectively, it is possible to lift the feed pile reliably so as to make adjustments for production, and reliably to lower the lifting chain and any possible remainder of the feed pile, respectively, by means of the drive so as to overcome opposing or counter-acting frictional forces and forces necessary for engaging or taking-up the new pile by means of dogs on the lifting chains, respectively, and if an obstacle is present which impedes the lowering of the pile, to achieve an immediate disconnection of the drive connection due to the greater forces acting between the pile and the obstacle. Thus, only the weights of the lowered feed pile act upon the obstacle in the event of a collision. The danger to the machine and personnel can thus be significantly reduced.

In accordance with another feature of the invention, the one of the driving means disconnectible by the disconnecting means from the pile-lifting chain is the second drive means for entraining the pile-lifting chain so as to lower the feed pile.

In accordance with a further feature of the invention, the driving connection comprises a drive shaft and a drive gear mounted on the shaft.

In accordance with an added feature of the invention, the safety device includes a torque-controlled clutch disposed between the drive shaft and the drive gear.

In accordance with an additional feature of the invention, disposed between the drive shaft and the drive gear, are a one-way clutch having an entraining direction corresponding to the direction of lifting motion of the feed pile, and a friction clutch having a drive connection until a given torque is reached.

In accordance with yet another feature of the invention, the safety device includes another revolving pile-lifting chain for lifting and lowering an auxiliary pile, another drive means having a drive connection with the other pile-lifting chain, means for disconnecting the drive connection between the other drive means and the other pile-lifting chain when a pile is lifted at a speed greater than a speed of the other pile-lifting chain produced by the other drive means, and means for disconnecting the drive connection when the pile is lowered.

In accordance with yet a further feature of the invention, the drive connection between the other drive means and the other pile-lifting chain includes a drive shaft and a drive gear mounted thereon, and disposed therebetween is a one-way clutch having an entraining direction corresponding to the direction in which the pile is lifted.

In accordance with yet an added feature of the invention, the safety device includes a limit switch disposed in an upper pile-lifting region for stopping a lifting motion of the pile.

In accordance with a concomitant mode, the method of the invention includes driving an additional freely revolving pile-lifting chain by means of another drive having a drive connection therewith so as to lift and lower, respectively, an auxiliary pile, and disconnecting the drive connection between the additional pile-lifting chain and the other drive if forces exerted in the direction of lifting and lowering, respectively, upon the pile-lifting chain by the pile exceed the forces exerted on the pile-lifting chain by the other drive.

With the construction of the safety device described hereinabove, it is possible also to extend safety also to any exposed lifting chains for lifting and lowering an auxiliary pile in the upper pile region of the sheet feeder of sheetfed processing machines. According to one such embodiment of the invention, it is not only possible to raise and lower the main pile safely and reliably, but also significantly to reduce possible dangers of a collision between the main pile and the auxiliary pile, for example, and the effects thereof. It is possible, for example, that a main pile may be lifted and that, because of operator failure, the pile rake may be inserted too soon, i.e., the rake is located below the position of the support fastened to the auxiliary pile.

Because of the construction according to the invention, the main pile does not work against the auxiliary pile, but rather, by means of the pile rake, can entrain and carry the support and the auxiliary pile chain upwardly without any formation of an accumulation of forces and without, respectively, any damage to machine parts and even possible injury to by-standers if machine parts were to fracture.

The device according to the invention is particularly simple and can be operated safely and requires little maintenance. It also affords a safe and reliable termination of the lifting motion before the pile can collide with the feeder means.

Other features which are considered as characteristic for the invention are set forth in the appended claims.

Although the invention is illustrated and described herein as embodied in a safety device and method in a sheet feeder of a sheet-fed processing machine, it is nevertheless not intended to be limited to the details shown, since various modifications and structural changes may be made therein without departing from the spirit of the invention and within the scope and range of equivalents of the claims.

Figure 2:
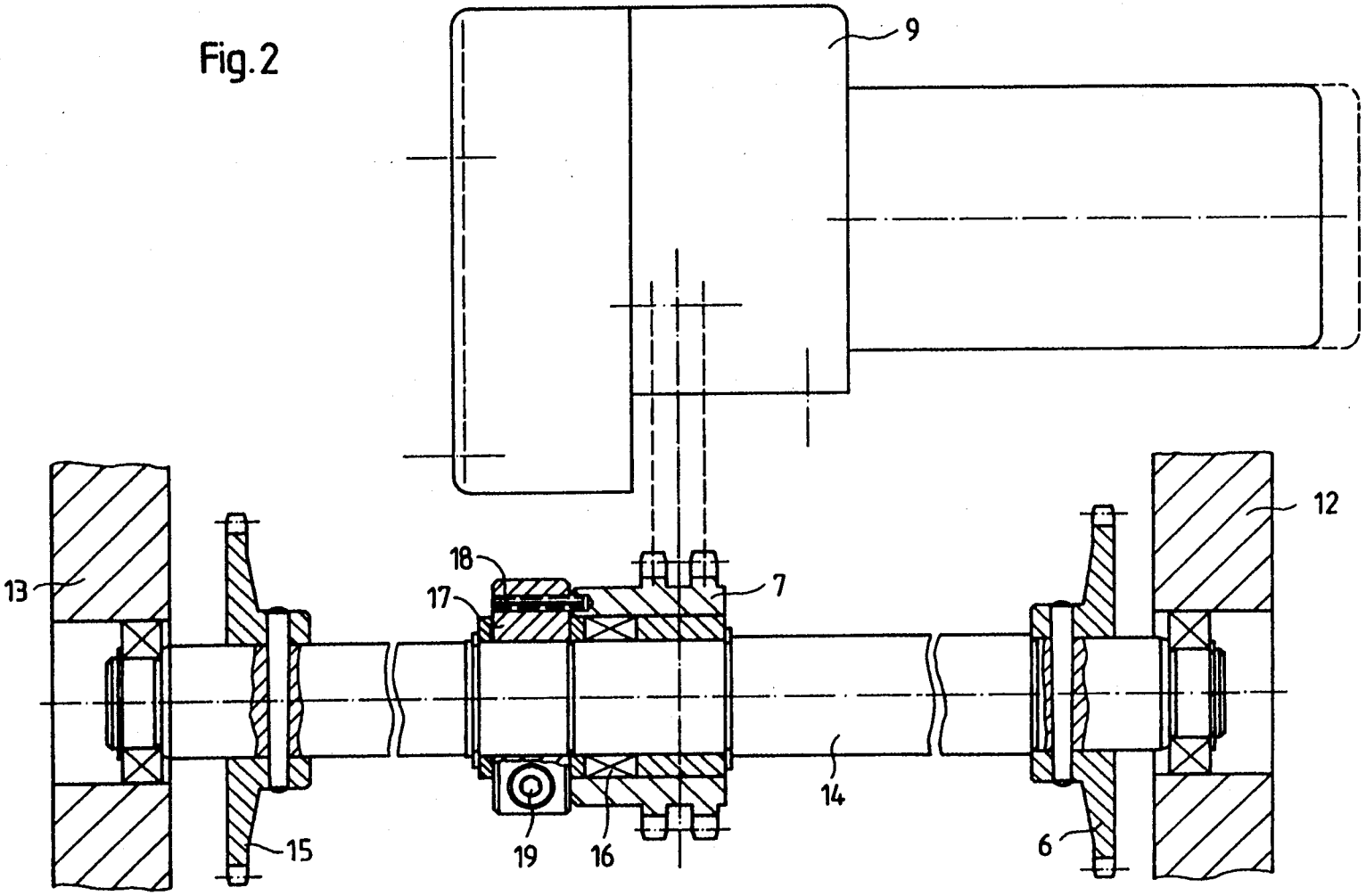
Figure 3:
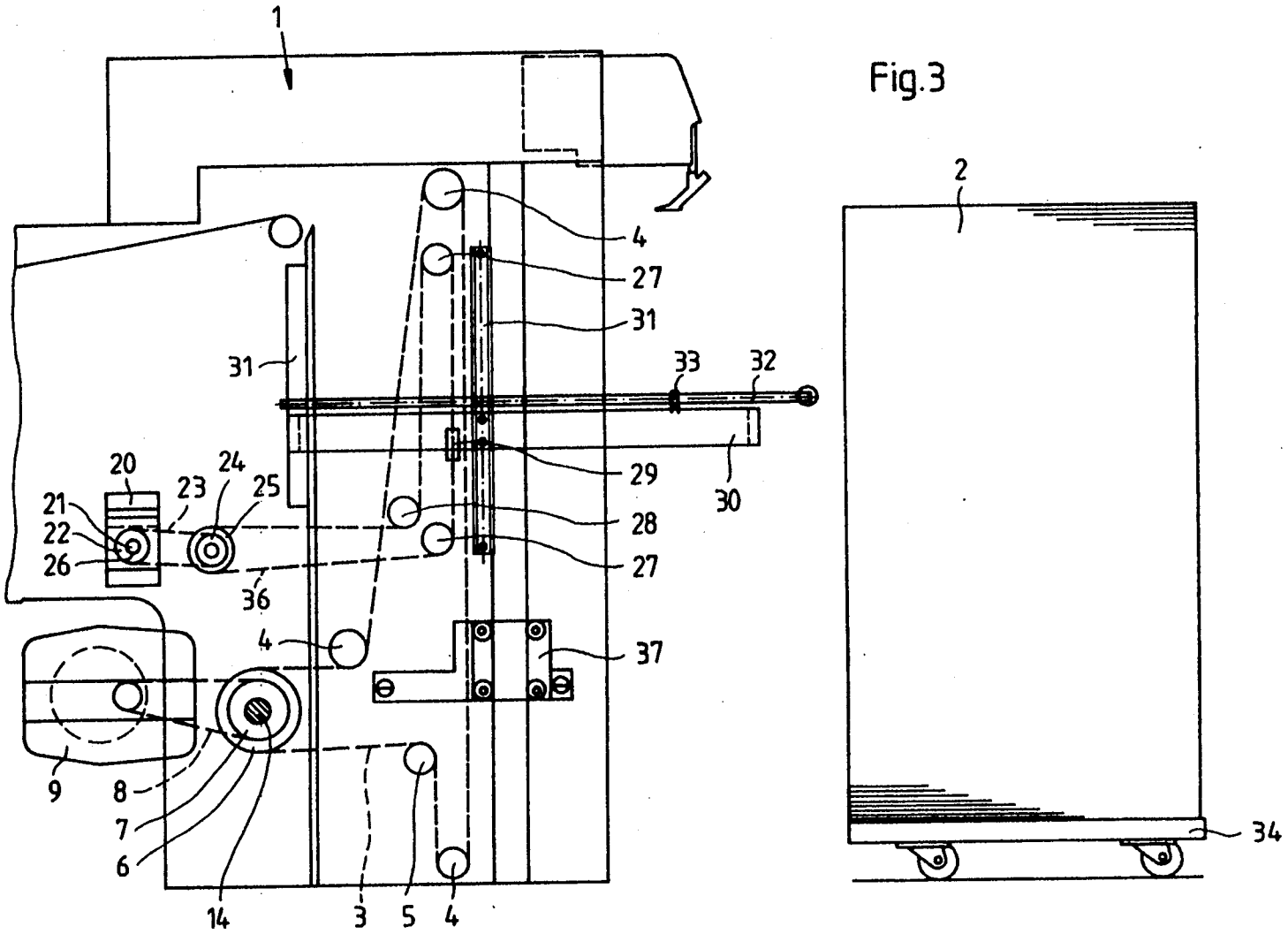
Figure 4:
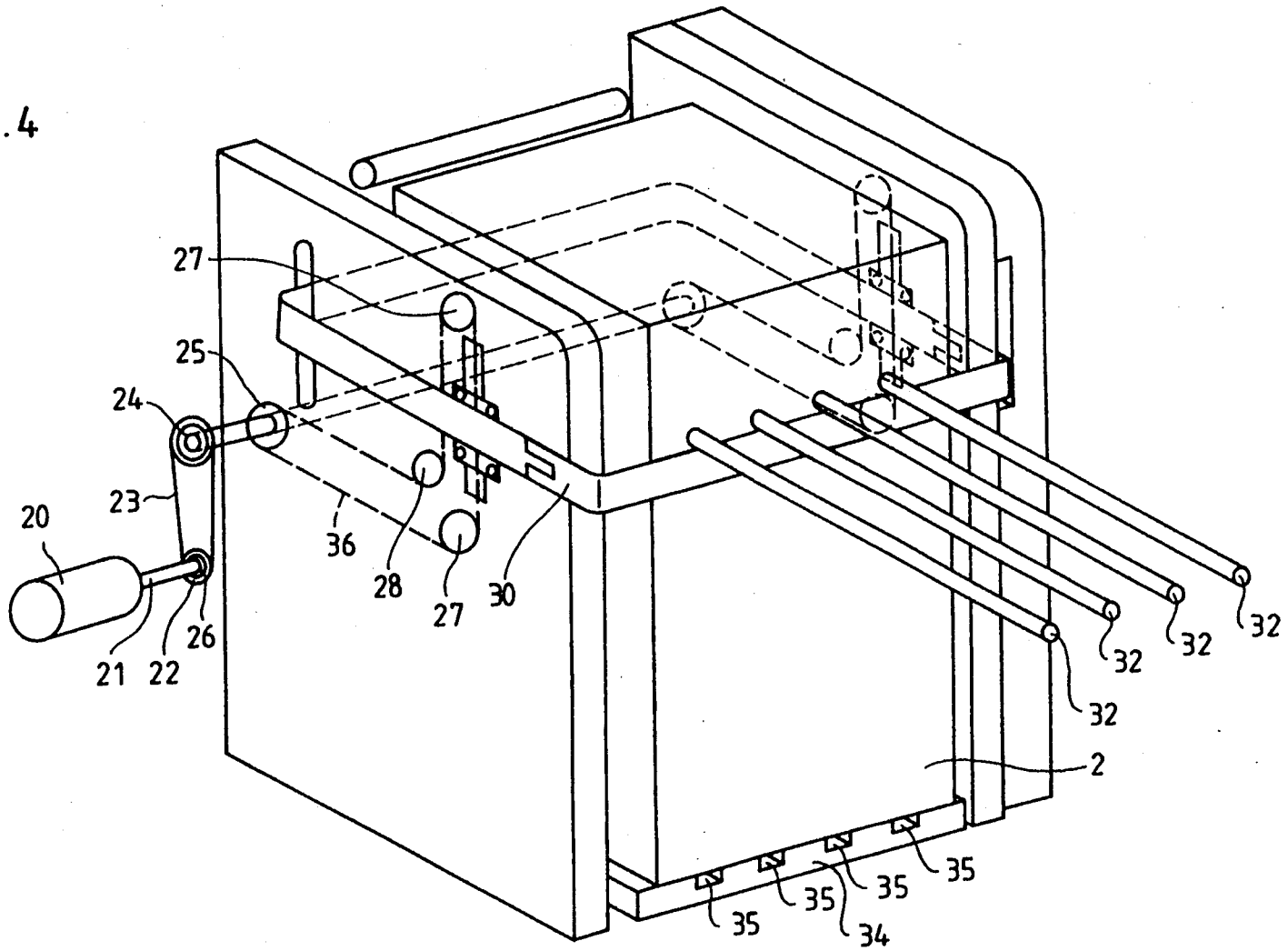

The construction and method of operation of the invention, however, together with additional objects and advantages thereof will be best understood from the following description of specific embodiments when read in connection with the accompanying drawings, in which:

FIG. 1 is a diagrammatic side elevational view of a feed pile in a sheet feeder incorporating the safety device according to the invention;

FIG. 2. is an enlarged fragmentary top plan view of FIG. 1, rotated through 90 degrees, and partly in longitudinal section, of a motor and a drive shaft forming part of the sheet feeder;

FIG. 3 is a slightly enlarged view like that of FIG. 1 of a feeder region of a pile feeder having a main and auxiliary pile drive; and FIG. 4 is a perspective view of the auxiliary pile drive of FIG. 3.

Referring now to the drawings and, first, particularly to FIGS. 1 and 2 thereof, there is shown a sheet feeder for an off-set printing press wherein a pile 2, which is loaded with paper sheets to be printed, is inserted into a pile take-up region 1. In the pile take-up region 1, a pile board 34 vertically displaceably mounted by guide rails 11 fastened at inner sides of two side frames 12 and 13 is taken up and raised in a conventional manner by an entrainer hook 10, which is connected to a drive motor 9. The entrainer hooks 10 are guidingly revolved via deflection wheels or rollers 4 mounted in the side frames 12 and 13 and via an additional gear, the right-hand chain via the gear 6 and the left-hand chain via the gear 15. As shown in FIG. 2, the chain or sprocket wheels 6 and 15 are fastened coaxially on a shaft 14. A chain or sprocket wheel 7 is mounted on the shaft 14 by means of a free-wheeling clutch 16 so as to be fixed against axial movement in the pile-lifting operating direction, and so as to be rotatable in the pile-lowering direction of operation. Parallel to the free-wheeling clutch 16, the sprocket wheel 7 is fastened by means of a pin 18 to a conventional friction clutch 17, which is fixed coaxially with the sprocket wheel 7 against axial displacement on the shaft 14, and which can be set by means of a setscrew 19 to a desired torque to be transmitted from the shaft 14 to the sprocket wheel 7, the friction clutch 17 being fixed against rotation relative to the shaft 14 up to the desired torque. When the set torque is exceeded, the friction clutch plate 17 begins to slip in relation to the shaft 14, so that the friction clutch disc 17 is then mounted rotatably on the shaft 14. The sprocket wheel 7 is connected by means of a revolving chain 8 to a motor 9 driving in both rotary directions.

To lift the pile 2, it is driven through the intermediary of the entraining hook 10, the revolving chains 3, the free-wheeling clutch 16, the sprocket wheel 7 and the chain 8 by the drive motor 9. When lowering the pile 2, the motor 9 rotates in the opposite rotary direction, driving the sprocket wheel 7 via the chain 8 and, via the friction clutch 17, the chains 3, and thereby the entraining hooks 10, downwardly. If the lowered entraining hooks 10, or a possibly lowered remainder of the pile 2, strike an obstacle located below, a torque is transmitted from the obstacle and introduced via the entrainer hooks 10, the chains 3 and the sprocket wheel 7 onto the shaft 14 which acts in a direction opposite to the direction of the driving motion of the motor 9. The torque necessary for effecting an entrainment acting from the drive 9 via the free-wheeling clutch 17 on the shaft 14 opposite to the torque introduced by the obstacle can be transmitted to the shaft 14 only if it does not exceed the limit value for a transmissible torque set by the setscrew 19. If the limit value is exceeded, the sprocket wheel 7 turns with respect to the shaft 14, and no further drive transmission occurs. The limit value for the transmissible torque is set so that possible torques introduced during the take-up of a stock pile board 34 by the entrainer hooks 10, for example, due to resistance forces which must be overcome by the entrainer hooks 10 for the purpose of catching or engaging the entrainer hooks 10 in holders provided, if possible, in the stock pile board 34, but also due to resistance forces generated by friction between the deflection wheels or rollers 4, the chain sprocket wheel 6 or the chain tightener or tension adjuster 5 and the chain 3, are reliably overcome.

FIGS. 3 and 4 show the pile take-up region of a so-called non-stop sheet feeder, wherein an additional auxiliary pile device is provided with the aforedescribed main pile device. A support frame 30 is fastened by suitable holders 29 to revolvingly guided chains 36 via deflection wheels or rollers 27 and chain tensioners or tighteners 28 journalled on the inside of the side frames 12 and 13, as well as via chain sprocket wheels 25. The support frame 30 is guidingly displaceable vertically in guides 31 disposed on the side frames 12 and 13. The chain sprocket wheels 25 are connected coaxially to and in a manner that they are fixed against rotation relative with another chain sprocket wheel 24, which is connected via a chain 23 to a further chain sprocket wheel 22. The latter sprocket wheel 22 is connected via a free-wheeling or overrunning clutch 26 to a drive shaft 21 of a drive motor 20. The entrainment direction of the free-wheeling clutch 26 is selected so that the motor 20 can lift the holders 29 via the free-wheeling clutch 26. The instant the pile 2 is lifted by the main chain drive 3 to an extent that grooves 35 formed in the stock pile board 34 are located above the support 30, conventional non-stop rods 32 or correspondingly configured fingers of a conventional non-stop rake can be inserted into the grooves 35 of the pile 2 until the forward ends of the rods and fingers, respectively, rest upon the support 30. By means of the drive motor 20 and the free-wheeling clutch 26, the chain 36, the support 30 and the non-stop rods 32 or the non-stop rake, respectively, the paper pile 2 can be lifted farther. The chain 3 can be lowered with the entrainer hooks 10 and the stock pile board 34, the stock pile board 34 can be removed and, after a new pile 2 with its own new stock pile board 34 has been inserted, this new stock pile board 34 can be taken up by the entrainer hook 10 and conveyed upwardly. As soon as the top sheet of the new pile 2, i.e., the pile 2 being conveyed by the entrainer hooks 10, has reached the rods 32, the latter can again be withdrawn from the pile region so that the entrainment only of the new pile 2 and the last sheet of the old pile 2 occurs again by means of the entrainer hooks 10. If the non-stop rods 32 or the non-stop rake, respectively, have already been inserted incorrectly into the grooves 35 of the stock pile board 34 below the support 30, the non-stop rods 32 or the non-stop rake, respectively, are pushed against the support 30 from below, and entrain the support 30 upwardly in the conveyance direction. Torque is transmitted to the chain sprocket wheel 22 by means of the chains 36 and 23 so that the chain sprocket wheel 22 rotates freely in accordance with the overrunning action of the free-wheeling clutch 26 on the shaft 21 of the more slowly driven motor 20. There is no reactive effect upon the motor 20.

The maximum lift or conveyed vertical distance of the top sheet of the pile 2 can be set, in a conventional manner, by means of a non-illustrated switch which, the instant such a maximum lift or conveyed vertical distance is reached, switches off the respective drive 20 or 9 which is active at that time.

I claim:

1. Safety device in a sheet feeder of a sheet-fed processing machine, comprising a freely revolving pile-lifting chain for lifting and lowering a feed pile, drive means for entraining said pile-lifting chain with a first driving connection so as to lift the feed pile and for entraining said pile-lifting chain with a second driving connection so as to lower the feed pile, means for disconnecting at least one of said driving connections of said drive means with said pile-lifting chain for lowering the feed pile when a limit value for a force exerted by the feed pile upon said pile-lifting chain is exceeded, said driving connections comprising a drive shaft and a drive gear mounted on said shaft and, disposed between said drive shaft and said drive gear, a one-way clutch having an entraining direction corresponding to the direction of lifting motion of the feed pile, and a friction clutch having a drive connection until a given torque is reached.

2. Safety device according to claim 1, wherein said one of said driving connections disconnectible by said disconnecting means from said pile-lifting chain is said second driving connection for entraining said pile-lifting chain so as to lower the feed pile.

3. Safety device according to claim 1, including a limit switch disposed in an upper pile-lifting region for stopping a lifting motion of the pile.

4. Safety device in a sheet feeder of a sheet-fed processing machine, comprising a freely revolving pile-lifting chain for lifting and lowering a feed pile, drive means for entraining said pile-lifting chain with a first driving connection so as to lift the feed pile and for entraining said pile-lifting chain with a second driving connection so as to lower the feed pile, means for disconnecting at least one of said driving connections of said drive means with said pile-lifting chain for lowering the feed pile when a limit value for a force exerted by the feed pile upon said pile-lifting chain is exceeded and including another revolving pile-lifting chain for lifting and lowering an auxiliary pile, another drive means having another drive connection with said other pile-lifting chain, means for disconnecting said drive connection between said other drive means and said other pile-lifting chain when an auxiliary pile is lifted at a speed greater than a speed of said other pile-lifting chain produced by said other drive means, and means for disconnecting said other drive connection when the auxiliary pile is lowered.

5. Safety device according to claim 4, wherein said drive connection between said other drive means and said other pile-lifting chain includes a drive shaft and a drive gear mounted thereon, and disposed therebetween is a one-way clutch having an entraining direction corresponding to the direction in which the auxiliary pile is lifted.

6. Safety method in a sheet feeder of a sheet-fed processing machine, which comprises driving a freely revolving pile-lifting chain by means of a drive having a drive connection therewith so as to lift a feed pile, driving the pile-lifting chain so as to lower the feed pile until a limit value for a force acting upon the pile-lifting chain is reached, disconnecting the drive connection between the freely revolving pile-lifting chain from the drive above this limit value, driving an additional freely revolving pile-lifting chain by means of another drive having a drive connection therewith so as to lift and lower, respectively, an auxiliary pile, and disconnecting the drive connection between the additional pile-lifting chain and the other drive if forces exerted in the direction of lifting and lowering, respectively, upon the pile-lifting chain by the auxiliary pile exceed the forces exerted on the pile-lifting chain by the other drive.

* * * * *